US006938382B2

(12) United States Patent
Schmitz

(10) Patent No.: US 6,938,382 B2
(45) Date of Patent: Sep. 6, 2005

(54) STOCKADE

(75) Inventor: Michael Schmitz, Rheinmünster (DE)

(73) Assignee: F. Von Langsdorff Licensing Limited, Inglewood (CA)

( * ) Notice: Subject to any disclaimer, the term of this patent is extended or adjusted under 35 U.S.C. 154(b) by 0 days.

(21) Appl. No.: 10/314,387

(22) Filed: Dec. 9, 2002

(65) Prior Publication Data

US 2003/0079418 A1 May 1, 2003

Related U.S. Application Data

(63) Continuation of application No. 09/927,461, filed on Aug. 13, 2001, now abandoned, which is a continuation of application No. PCT/EP00/00981, filed on Feb. 8, 2000.

(30) Foreign Application Priority Data

Feb. 2, 1999 (DE) ..... 199 05 842

(51) Int. Cl.[7] ..... E04B 1/32

(52) U.S. Cl. ..... 52/89; 52/71; 52/81.1; 52/81.4; 52/311.1; 52/270; 52/284; 52/569; 52/570; 52/596; 52/603; 52/604; 52/605; 52/608; 52/609; 52/612; 404/34; 404/39; 404/41; 404/45

(58) Field of Search ..... 52/71, 81.1, 81.4, 52/89, 311.1, 270, 284, 569, 570, 596, 603–605, 608–609, 612, 311.1 B, 596 B

(56) References Cited

U.S. PATENT DOCUMENTS

| | | | | | |
|---|---|---|---|---|---|
| 991,009 | A | * | 5/1911 | Myers | 52/444 |
| 1,367,511 | A | * | 2/1921 | Cathroe | 52/245 |
| 1,502,438 | A | | 7/1924 | Price | |
| 2,036,363 | A | | 4/1936 | Schaefer | |
| 2,155,026 | A | * | 4/1939 | Tracy | 122/156 |
| 2,780,150 | A | | 2/1957 | Yeoman | |
| 3,346,248 | A | * | 10/1967 | Martinet et al. | 432/119 |
| 3,537,687 | A | * | 11/1970 | Adelman | 256/19 |
| 3,732,653 | A | * | 5/1973 | Pickett | 52/71 |
| 4,111,401 | A | * | 9/1978 | Pickett | 256/13.1 |
| 4,402,384 | A | | 9/1983 | Smith et al. | |

(Continued)

FOREIGN PATENT DOCUMENTS

| | | |
|---|---|---|
| DE | 814 873 | 9/1951 |
| DE | 33 22 110 A1 | 12/1984 |
| DE | 35 05 530 A1 | 8/1986 |
| DE | 195 15 636 A1 | 11/1995 |
| DE | 297 15 696 U1 | 1/1998 |
| DE | 197 13 037 A1 | 10/1998 |
| EP | 0 385 950 A2 | 9/1990 |
| FR | 2 657 638 A1 | 8/1991 |

*Primary Examiner*—Carl D. Friedman
*Assistant Examiner*—Christy M. Green
(74) *Attorney, Agent, or Firm*—Cahn & Samuels, LLP

(57) ABSTRACT

A palisade comprises visible or wall surfaces disposed on opposing sides and intermediate end faces. One of the end faces is provided with a projecting convex head, while the other end face comprises a correspondingly formed concave receptacle for the head. When forming a palisade wall, the head of a palisade can engage in the receptacle of a neighboring palisade such that the head substantially completely fills the receptacle. To be able to bend neighboring palisades relative to one another over a large angle and to increase the design possibilities of a palisade wall, the head and the receptacle are disposed eccentrically on the respective end face and preferably in the corner region between the end face and the associated visible or wall surface.

16 Claims, 4 Drawing Sheets

U.S. PATENT DOCUMENTS 4,532,747 A * 8/1985 Koetje ..... 52/586.1
4,695,502 A 9/1987 Rush
RE32,663 E * 5/1988 Atkinson ..... 405/19
4,776,728 A * 10/1988 Sprehn ..... 405/285
4,830,376 A * 5/1989 Hillis ..... 273/157 R
4,850,739 A * 7/1989 Gargollo ..... 404/41
4,875,803 A * 10/1989 Scales ..... 405/16
D305,568 S 1/1990 Sakata
4,945,362 A * 7/1990 Keiser ..... 343/841
4,982,535 A * 1/1991 Pickett ..... 52/71
5,035,532 A * 7/1991 Gargollo ..... 404/41
5,080,523 A * 1/1992 Steiner ..... 404/7
5,134,815 A * 8/1992 Pickett ..... 52/71
5,154,032 A * 10/1992 Ritter ..... 52/592.1
5,202,166 A * 4/1993 Crompton et al. ..... 428/33
D341,098 S * 11/1993 Yodock ..... D10/109
5,348,417 A * 9/1994 Scheiwiller ..... 404/41
5,409,227 A * 4/1995 Walker ..... 273/157 R
5,409,325 A * 4/1995 Wu ..... 404/34
5,428,934 A * 7/1995 Tomek ..... 52/608
5,449,245 A * 9/1995 Glickman ..... 404/38
D367,715 S 3/1996 Joubert
5,513,475 A * 5/1996 Schaaf et al. ..... 52/606
5,536,111 A * 7/1996 Doernemann ..... 405/16
5,556,228 A * 9/1996 Smith ..... 405/16
5,601,470 A * 2/1997 Yao ..... 446/127
D397,780 S 9/1998 Chandaria
5,890,836 A * 4/1999 Leech ..... 405/16
5,902,069 A * 5/1999 Barth et al. ..... 404/34
D412,620 S * 8/1999 Vu ..... D6/351
6,071,041 A * 6/2000 Knight ..... 405/16
6,073,929 A * 6/2000 Nahon ..... 273/156
6,079,902 A * 6/2000 Pettee, Jr. ..... 405/35
D435,305 S * 12/2000 Pullen et al. ..... D25/164
6,276,870 B1 * 8/2001 Smith ..... 405/17
RE37,694 E * 5/2002 Riccobene ..... D8/1
6,394,705 B1 * 5/2002 Lefebvre ..... 405/262
6,508,607 B1 * 1/2003 Smith et al. ..... 405/20
6,550,769 B1 * 4/2003 Munson ..... 273/153

* cited by examiner

STOCKADE

This application is a continuation of U.S. application Ser. No. 09/927,461 filed on Aug. 13, 2001, now abandoned, which is incorporated herein by reference and is a continuation of PCT Application No. PCT/EP00/00981 filed on Feb. 8, 2000, which claims the benefit of German application number 199 05 842.3 filed on Feb. 12, 1999.

The invention concerns a palisade with visible or wall surfaces arranged on opposite sides, and intermediate end sides, wherein a projecting convex head is formed on one of the end sides and a concave receptacle is formed on the other end side and wherein the head and the receptacle engage a receptacle or head of a neighboring palisade when building a palisade wall such that the head substantially completely fills the receptacle.

The burying of palisades, vertically in the ground or the fixing thereof in a different manner, one next to the other, to form walls has been conventional for a long time. While the palisades originally served as protecting walls, they are also used today for designing gardens and outdoor areas, e.g., for elevated garden beds, slope supports, terraces etc. The palisades are usually made from wood or concrete and are anchored in the earth with a concrete, foundation. If the palisades are subjected to only little loading, it may be sufficient to merely bury them in the ground.

An example of a wall formed of palisades disposed one next to the other is described below. It can either stand freely or be filled up with earth, at least on one side.

In previous times, logs were usually used for palisades which therefore had a substantially circular cross-section. Modern palisades are mostly produced as prefabricated concrete parts, which permits adjustment of the cross-sectional shape of the palisades to the requirements. Such a palisade, as disclosed in DE 297 15 696 U1, has visible or wall surfaces disposed on two opposing sides, which form, together with the corresponding visible or wall surfaces of neighboring palisades, the surfaces of the erected wall. Each end of visible or wall surfaces of the palisade has one end face which extends substantially perpendicular to the visible or wall surfaces. When the palisades are disposed next to one another, neighboring palisades are disposed such that their adjacent end faces abut one another.

Each individual palisade is stabilized through embedding in the ground. For better acceptance of localized forces substantially perpendicular to plane of the wall, DE 297 15 696 U1 proposes the mutual engagement of neighboring palisades such that transverse loads acting on a palisade are also transferred to neighboring palisades and are also accented thereby to increase the stability of the wall.

The mutual engagement of neighboring palisades is achieved in that one end face is provided with a head of semi-circular convex configuration extending substantially about the entire width of the end face and being centrally aligned, and the opposite end face is provided with a complementary receptacle in the form of a groove having the shape of a partial circle which also extends over the entire width of the end face. Since the head can be disposed at different positions within the receptacle, a kind of joint, having a vertical joint axis, is formed between neighboring palisades which permits angling between neighboring palisades and formation of polygonally curved walls.

It has, however, turned out that the configuration possibilities of known palisades are relatively limited and have disadvantages with regard to appearance. One reason therefor is that the degree of angling between two neighboring palisades is limited and another reason is that formation of a smooth continuous wall surface is not possible due to the head, projecting at the end faces. Therefore, a plurality of recesses are formed in the surfaces of the palisade wall which prevent construction of a flat wall surface and produce a visually uneven surface. Moreover, the edge for connection to base plates is not straight due to the recesses in the foot region of the palisades leading to gaps in the transitional region between the wall and the base area which tend to get dirty and which attract moss or weeds.

DE 195 15 636 A1 discloses a rod-shaped palisade made of concrete each of whose end faces bears a hook-like, eccentrically displaced projection. The projections on the two end faces are thereby displaced to opposing sides such that the facing projections of neighboring palisades can abut one another. A defined joint having a convex head which engages in a correspondingly formed concave receptacle is not provided. A wall formed from such palisades has the above-described disadvantages with respect to design possibilities and the formation of grooves.

It is the underlying purpose of the invention to produce a palisade of the above-mentioned type which eliminates the above-mentioned problems and whose constructive design provides the user with a plurality of design possibilities for constructing a palisade wall.

This object is achieved in accordance with the invention with a palisade whose head and receptacle are disposed eccentrically and in a same direction on the respective end face.

The equal displacement of the head and receptacle in a transverse direction of the palisade, e.g. perpendicular to the visible or wall surfaces, results in the head and the receptacle not being adjacent to one of the visible or wall surfaces, which permits formation of a continuous wall surface on that side of the palisade. The head is not visible from this palisade side.

The asymmetrical arrangement of the head and receptacle also permits a considerable increase in design possibilities for the user since different wall designs can be produced depending on the mutual alignment of neighboring palisades.

The centers of the head and receptacle can be displaced by any degree from the vertical central or wall plane of the palisade and can be located either between the two visible or wall surfaces or also outside thereof.

The head and receptacle are each preferably displaced in the transverse direction up to the edge of the end faces such that they are each disposed in the corner region between the respective end face and the associated visible or wall surface. This causes the head to project relatively far beyond the palisade and is easy to access, such that the joint formed by the head and a receptacle engaging therewith, can be adjusted over a large angular region. The head, which becomes visible, prevents formation of a large gap for curved paths.

In a possible embodiment, the visible or wall surfaces and the end faces extend substantially perpendicular to one another and the point of intersection or line of intersection between the visible or wall surface bearing the head and the end face bearing the head, lies within the cross-section of the head. In this connection, the center of the head may either be within or outside of the core cross-section of the palisade which is defined by the visible or wall surfaces or end faces. The center of the cross-section of the head can be disposed in the plane of the visible or wall surface bearing the head and between the end faces. Alternatively, the cross-sectional center of the head may also be disposed between the visible or wall surfaces and between the end faces, i.e. within the core cross-section of the palisade.

The cross-sectional center of the head is outside of the core cross-section of the palisade when it is disposed outside of the visible or wall surface bearing the head and/or outside of the end face bearing the head. The center of the cross-section of the head can also be disposed in the plane of the end face bearing the head and between the two visible or wall surfaces rather than in the plane of the visible or wall surface bearing the head.

A particular embodiment of the invention provides that the center of the cross-section of the head is disposed in the point of intersection between the visible or wall surface bearing the head and the end face bearing the head, i.e. exactly in a corner point of the core cross-section of the palisade.

One possible embodiment provides that the head has the cross-section of a partial circle which extends from the outside of the associated visible or wall surface through an angle of approximately 270° to the surface of the associated end face. Alternatively, the head can have a polygonal cross-section, in particular in the shape of a regular polygon, wherein the head and the receptacle can be disposed only in predetermined relative positions which, however, improves engagement and prevents rotation. The circular design of the head and of the receptacle permits continuous adjustment of the angle between neighboring palisades.

The receptacle, displaced, relative to the center of the palisade, transversely towards the same side as the head has a shape which is complementary to the design of the head. The receptacle is preferably formed as a groove having either a partially circular cross-section or a polygonal cross-section depending on the design of the head. The receptacle is disposed in a corner region between the respective end face and associated visible or wall surface and has a contour extending over an angular region of between approximately 45° to 180° and preferably 90°.

The visible or wall surfaces can be smooth or may have a surface structure or striations to provide the palisade wall with a pleasing or improved design. Alternatively or additionally, the visible or wall surfaces can have a convex or concave curvature.

The palisade is preferably made from concrete and has a substantially constant cross-section throughout its height. It may or may not be reinforced, depending on the size of the loads to be accommodated.

Further details and features of the invention can be extracted from the following description of embodiments with reference to the drawings.

Figure 1:
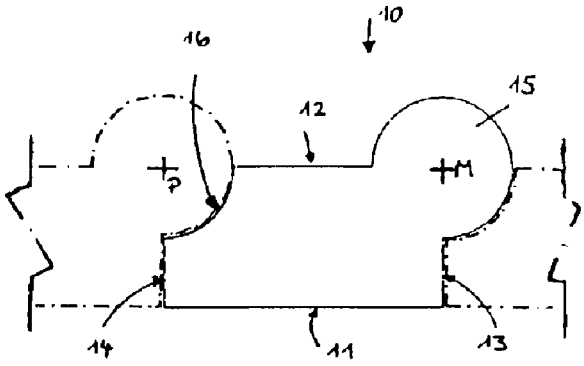
FIG. 1 shows a cross-section through a palisade in accordance with a first embodiment.

A palisade 10 shown in cross-section in FIG. 1 is made from concrete and has a substantially constant cross-section throughout its height, i.e. perpendicular to the plane of the drawing. It has a first visible or wall surface 11 which is substantially flat and, on the opposing side, a second visible or wall surface 12 extending parallel thereto which is also flat. Lateral end faces 13 and 14 extend perpendicular to the two visible or wall surfaces 11 and 12, on opposing sides.

An integral head 15 is formed in the corner region between one end face 13 (on the right-hand side in FIG. 1) and the second visible or wall surface 12, and has a cross-section shaped as a convex arc of a circle whose center M lies in the point of intersection between the end face 13 and the visible or wall surface 12. The circular circumferential region of the head 15 extends through an angle of 270° from the second visible or wall surface 12 to the end face 13. In the embodiment shown, the radius of the head corresponds substantially to half the width of the palisade, i.e. half the separation between the two visible or wall surfaces 11 and 12.

A concave receptacle 16, shaped as groove, is formed in the corner region between the opposing end face 14 and the second visible or wall surface 12 and has a radius of curvature corresponding to the radius of the head 15 and a center P lying in the point of intersection between the end face 14 and the second visible or wall surface 12. The concave receptacle 16 extends through an angle of 90° between the end face 14 and the second visible or wall surface 12.

Figure 5:
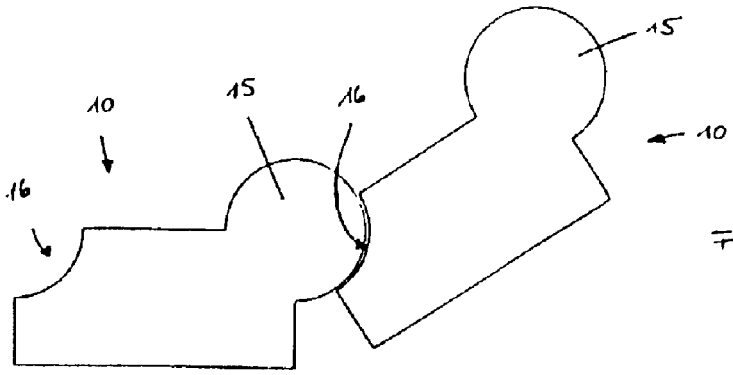
FIG. 5 shows two palisades in accordance with FIG. 1 with mutual engagement thereby to form a bend.

To form palisade wall, several palisades 10 are disposed one next to the other (broken lines n FIG. 1), wherein he head of a palisade engages in the recess of the neighboring palisade and the facing ends of neighboring palisades abut one another. Since the receptacle 16 only extends through an angular region of approximately 90° while the head 15 has a circumferential region of 270°, neighboring palisades can be disposed in arbitrary alignment with respect to one another through an angular range of 180°, wherein each head lies in and completely fills the receptacle. In this fashion, neighboring palisades can form bends through a large angular range. A possible curvature between two neighboring palisades in accordance with FIG. 1 is shown in FIG. 5.

The engagement of the head in the receptacle of a neighboring palisade ensures that selective forces which occur transverse to-the wall plane are also accommodated and accepted by several Palisades, thereby increasing the stability of the palisade wall.

Figure 2:
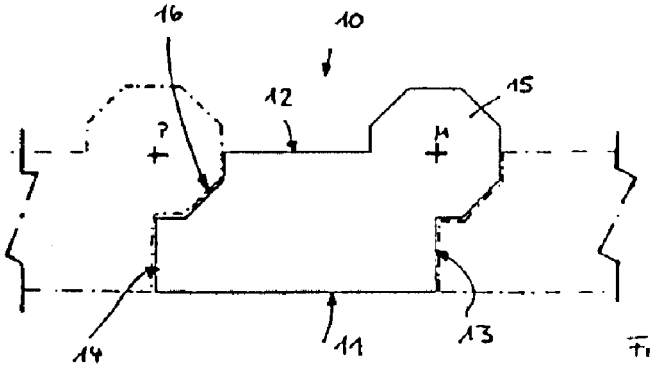
FIG. 2 shows a cross-section through a palisade in accordance with a second embodiment.
Figure 6:
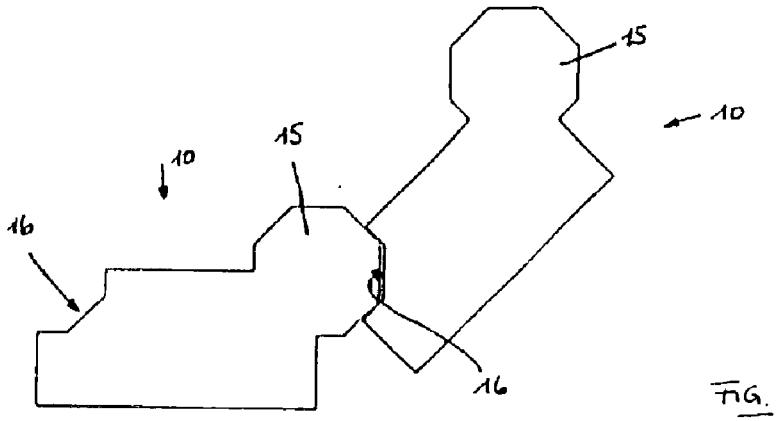
FIG. 6 shows two palisades in accordance with FIG. 2 with mutual engagement thereby to form a bend.

FIG. 2 shows an alternative embodiment of a palisade 10 which only differs from the palisade in accordance with FIG. 1 in that the head 15 has a polygonal convex cross-section in the shape of a regular polygon instead of a partial circle. FIG. 2 shows a head having a circumference of 270° in the form of a regular octagon. The receptacle 16 is correspondingly formed through a 90° section of the associated octagon such that the head 15 can engage in the receptacle 15 of a neighboring palisade. In contrast to the embodiment in accordance with FIG. 1, the polygonal shape of the head and the receptacle do not permit continuous adjustment of two neighboring palisades relative to one another, rather define predetermined angular adjustments. In the embodiment shown in FIG. 2, five different positions between two neighboring palisades are possible, of which one straight alignment is indicated in broken lines in FIG. 2. FIG. 6 shows an angled configuration.

Figure 3:
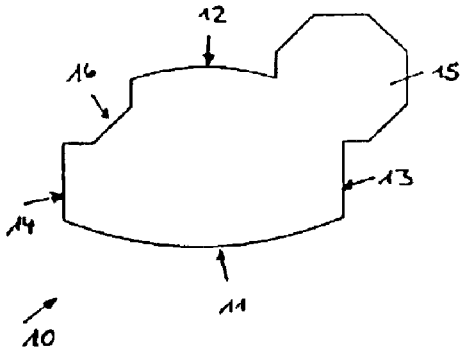
FIG. 3 shows a first modification of the palisade in accordance with FIG. 2.

In contrast to the embodiments in accordance with FIGS. 1 and 2, where the two visible or wall surfaces 11 and 12 extend parallel to one another, FIG. 3 shows a modification wherein both the first visible or wall surface 11 and the second visible or wall surface 12 are convexly outwardly curved. The shape of the head and the receptacle remain unchanged. Although FIG. 3 shows a polygonal head and a polygonal receptacle, the curved visible or wall surfaces can also be provided with a head in the shape of a partial circle and corresponding receptacle in accordance with FIG. 1.

Figure 4:
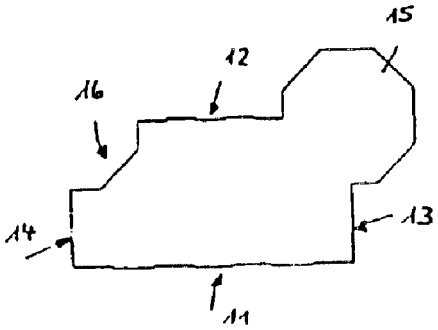
FIG. 4 shows a second modification of the palisade in accordance with FIG. 2.
Figure 7:
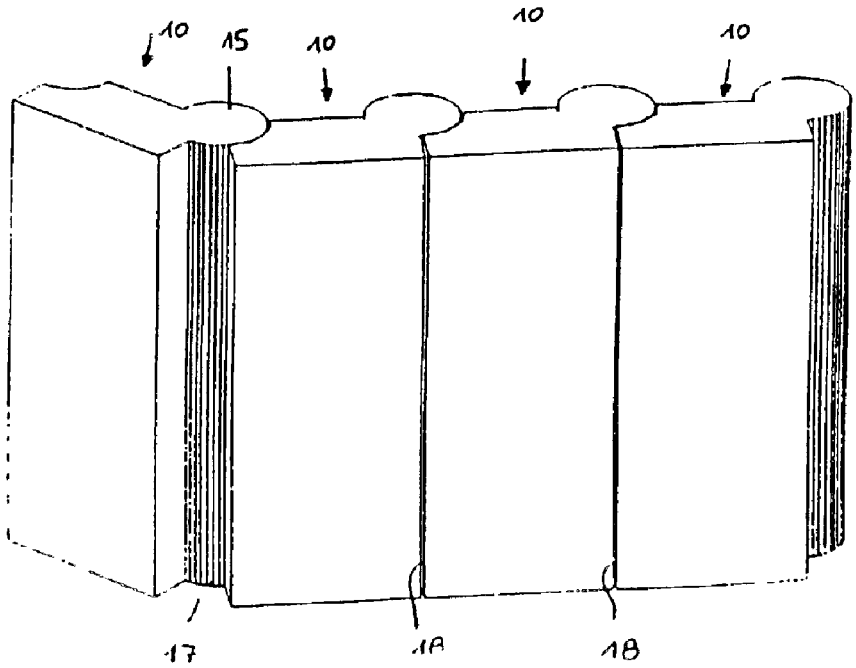
FIG. 7 shows a front view of a first embodiment of a palisade wall.

The embodiment of FIG. 4 differs from the previous embodiments in that the visible or wall surfaces 11 and 12 are slightly structured with elevations and depressions. This feature can be provided irrespective of the shape of the head and receptacle as well as the orientation of the visible or wall surfaces FIG. 7 shows a section of a palisade wall which is constructed from four identical palisades 10. The three right-hand side palisades are thereby aligned linearly with respect to one another such that their facing ends directly abut one another and the front visible or wall surfaces 11 have a smooth outer surface which is substantially continuous and only interrupted by the relatively small gaps 18 between the palisades. The left-hand sided palisade of FIG. 7 is angled by approximately 45° with respect to its neighboring palisade, wherein the head is still disposed in the receptacle of the neighboring palisade. The angled region has an open gap 17 through which the column-like head 15 can be seen.

Figure 8:
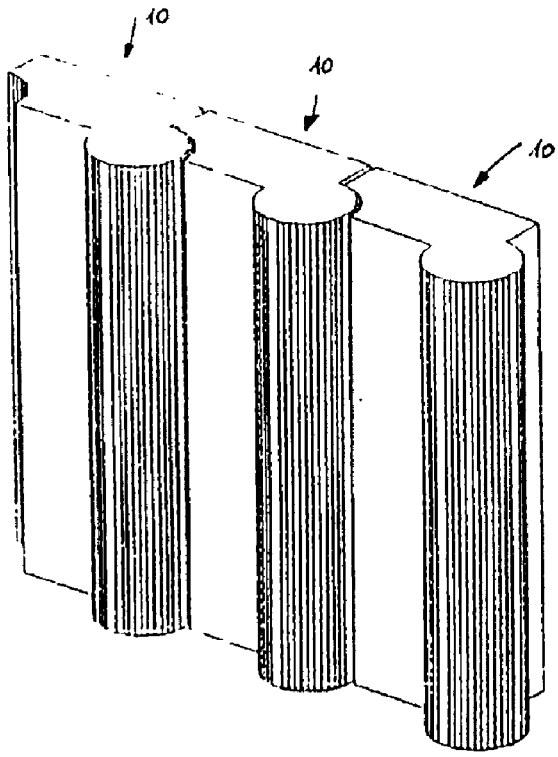
FIG. 8 shows the rear view of the palisade wall in accordance with FIG. 7.

FIG. 8 shows the rear view of a palisade wall having three linearly aligned palisades, wherein the heads appear as semicircular projections. The rear side (not visible) has a substantially flat surface.

Figure 9:
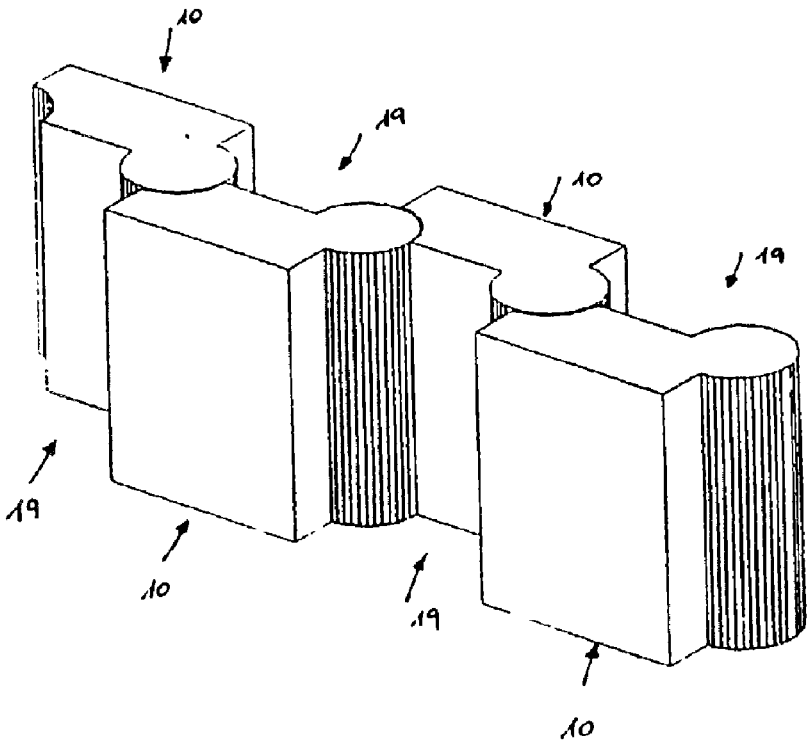
FIG. 9 shows a front view of a second embodiment of a palisade wall.

The displacement in accordance with the invention of both the head and receptacle away from the central plane of the palisade towards one corner point permits variation of the alignment of neighboring palisades when forming a palisade wall This is evident in the embodiment of FIG. 9 wherein neighboring palisades are each disposed rotated through a vertical axis by 180°. This produces a palisade wall having neighboring palisades which are displaced with respect to each other, transverse to the wall, by one palisade width to achieve a pleasing surface structure with alternating projecting areas and depressions 19. In this embodiment, neighboring palisades can clearly also be angled relative to one another.

The cross-section of a palisade shown in FIG. 1 has the special feature that the center M of the head 15, having the shape of a convex partial circle, is located directly at the point of intersection between the end face 13 and the visible or wall surface 12 extending perpendicular thereto. FIGS. 10 to 15 each show somewhat different positions of the head 15 and therefore also of the receptacle 16, wherein in all embodiments shown, the point of intersection S of the visible or wall surface 12 bearing the head 15 and the associated end face 13 bearing the head 15 lies within the cross-section of the head 15.

The palisade cross-sections shown in FIGS. 10 to 15 have a core cross-section which is defined by the two flat parallel visible or wall surfaces 11 and 12 and the two flat and also parallel end faces 13 and 14 which extend perpendicular to the visible or wall surfaces 11 and 12. The point of Intersection S between the visible or wall surface 12 bearing the head 15 and the associated right-hand sided end face 13 bearing the head 15 is therefore at a corner point of the core cross-section. The point S' represents the point of intersection of the two surfaces between which the receptacle 16 extends, i.e. the point of intersection between the upper visible or wall surface 12 and the end face 14 facing away from the head.

Figure 10:
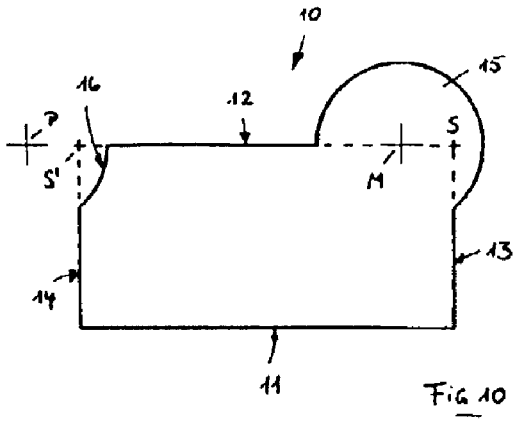
FIGS. 10, 11, 12, 13, 14, 15 show the cross-section of a palisade in accordance with FIG. 1 with different head and receptacle positions.

As shown in FIG. 10, the center M of the head 15, shaped as a convex partial circle, lies in the plane of the upper visible or wall surface 12 and between the two end faces 13 and 14 such that the head is, compared to the cross-sectional configuration of the palisade in accordance with FIG. 1, drawn inwardly along the upper visible or wall surface 12 by an amount given by the separation between the points M and S. The center P of the receptacle 16 is correspondingly displaced towards the outside with respect to the point of intersection S' by the same amount.

Figure 11:
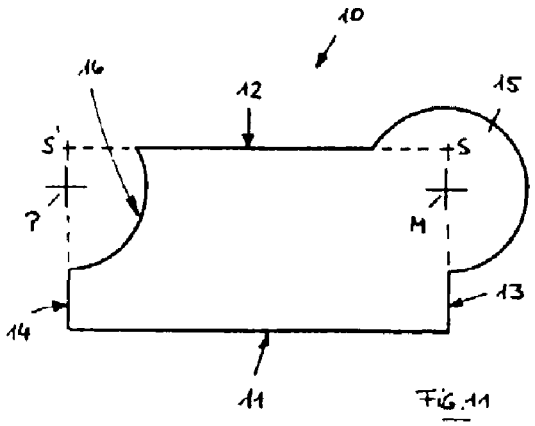

FIG. 11 shows a similar design, wherein the center M of the head lies in the plane of the right-hand end face 13 and is also disposed between the two visible or wall surfaces 12, i.e. is displaced on the end face 13 with respect to the embodiment of FIG. 1 by the separation between the points S and M and towards the center of the palisade.

Correspondingly, the center P of the receptacle 16 on the left-hand end face 14 is displaced towards the center of the palisade with respect to the point of intersection S' by the same amount.

Figure 12:
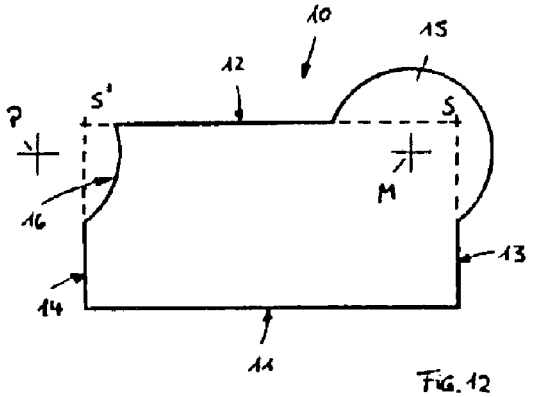
Figure 13:
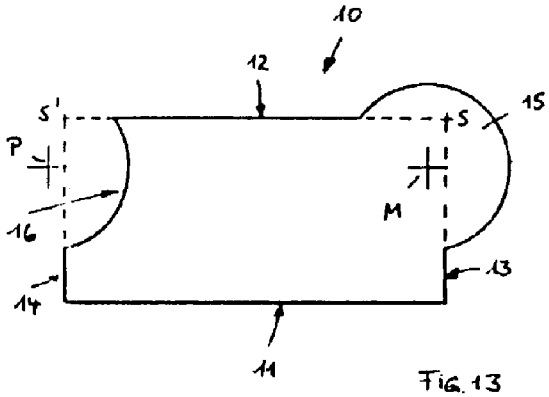

FIGS. 12 and 13 each show a configuration of a palisade having the center M of the head 15 disposed within the core cross-section of the palisade, i.e. inwardly displaced with respect to the embodiment of FIG. 1 in a transverse and also longitudinal direction of the palisade. In this connection, the displacement can be the same or different in the two directions as shown in FIGS. 12 and 13. In accordance with FIG. 12, the displacement of the center M, with respect to the point of intersection S, in the longitudinal direction of the palisade, i.e. parallel to the visible or wall surfaces 11 and 12, is larger than in the transverse direction extending perpendicular thereto. In accordance with FIG. 13, the displacement is larger in the transverse direction than in the longitudinal direction of the palisade. In both cases, the center P of the receptacle 16 is also correspondingly displaced with respect to the point of intersection S'.

Figure 14:
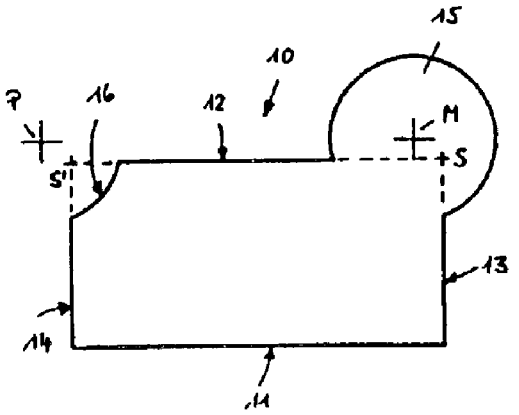
Figure 15:
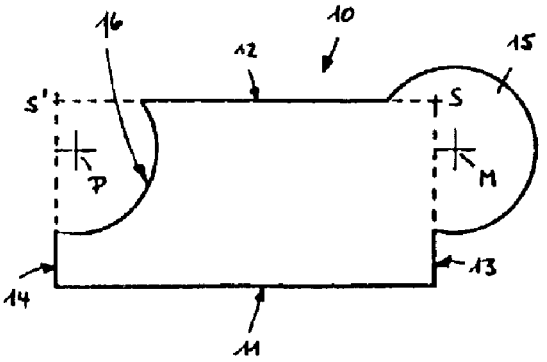

To obtain as large a projection of the head 15 as possible, the center M of the head 15 can also be disposed outside of the core cross-section of the palisade, as shown in FIGS. 14 and 15. In this case as well, similar displacements can be effected in the longitudinal and transverse directions of the palisade. FIGS. 14 and 15, however, show different displacements in the longitudinal and transverse directions of the palisade. In accordance with FIG. 14, the inward displacement of the center M, with respect to the point of intersection S, in the longitudinal direction of the palisade is larger than the outward displacement in the transverse direction In accordance with FIG. 15, the inward displacement of the center M, relative to the point of intersection S, in the transverse direction is larger than the outward displacement in the longitudinal direction of the palisade. Also in these two cases, the center P of the receptacle 16 is correspondingly displaced with respect to the point of intersection S'.

What is claimed is:

1. A palisade with visible or wall surfaces disposed on opposing sides, and lateral end faces, wherein one of the end faces is provided with a single projecting convex head portion and the other end face is provided with a single concave receptacle portion, and wherein the head and the receptacle engage with one receptacle or head of a neighboring palisade when forming a palisade wall, such that the head substantially completely fills the receptacle, wherein the head and the receptacle are eccentrically disposed in a same direction on the respective end face, and wherein said head projects outwardly from the planes of one of said visible or wall surfaces and one of said end faces end wherein said palisade comprises a unitary concrete structure formed with said head and said receptacle.

2. The palisade in accordance with claim 1, wherein the head and the receptacle are each disposed in a corner region between the respective end face and the visible or wall surface.

3. The palisade according to claim 2, wherein the visible or wall surfaces and the end faces extend substantially perpendicularly to one another and that the point of intersection of the visible or wall surface bearing the head and the associated end face bearing the head, lies within the cross-section of the head.

4. The palisade in accordance with claim 3, wherein the center of the cross-section of the head is disposed in the plane of the visible or wall surface bearing the head and between the end faces.

5. The palisade in accordance with claim 3, wherein the center of the cross-section of the head is disposed between the visible or wall surfaces and between the end faces.

6. The palisade in accordance with claim 3, wherein the center of the cross-section of the head is disposed outside of the visible or wall surface bearing the head or the end face bearing the head.

7. The palisade in accordance with claim 3, wherein the center of the cross-section of the head is disposed in the plane of the end face bearing the head and between the visible or wall surfaces.

8. The palisade in accordance with claim 3, wherein the center of the cross-section of the head is disposed in the point of intersection of the visible or wall surface bearing the head and the end face bearing the head.

9. The palisade in accordance with claim 1, wherein the head has cross-section of a partial circle.

10. The palisade in accordance with claim 1, wherein the head has a partial polygonal cross-section.

11. The palisade in accordance with claim 1, wherein the circumference of the head extends through an angle of approximately 270°.

12. The palisade in accordance with claim 1, wherein the receptacle is a groove.

13. The palisade in accordance with claim 1, wherein the receptacle has a cross-section of a partial circle.

14. The palisade in accordance with claim 1, wherein the receptacle has a partial polygonal cross-section.

15. The palisade in accordance with claim 1 wherein the receptacle extends through an angle of approximately 90°.

16. The palisade in accordance with claim 1, wherein at least one of the visible or wall surfaces is curved or provided with a surface structure.

* * * * *

UNITED STATES PATENT AND TRADEMARK OFFICE

CERTIFICATE OF CORRECTION

PATENT NO. : 6,938,382 B2
DATED : September 6, 2005
INVENTOR(S) : Michael Schmitz It is certified that error appears in the above-identified patent and that said Letters Patent is hereby corrected as shown below:

Column 6,
Line 65, change the second "end" to -- and --.

Signed and Sealed this

Twenty-ninth Day of November, 2005

JON W. DUDAS
*Director of the United States Patent and Trademark Office*